US009126318B2

(12) United States Patent
Cheung et al.

(10) Patent No.: US 9,126,318 B2
(45) Date of Patent: Sep. 8, 2015

(54) MULTIFUNCTIONAL NAIL GUN

(71) Applicant: Kwai King Cheung, Hong Kong (CN)

(72) Inventors: Kwai King Cheung, Hong Kong (CN); Chun Kin Yeung, Hong Kong (CN)

(73) Assignee: Kwai King Cheung, Hong Kong (CN)

( * ) Notice: Subject to any disclaimer, the term of this patent is extended or adjusted under 35 U.S.C. 154(b) by 482 days.

(21) Appl. No.: 13/674,066

(22) Filed: Nov. 11, 2012

(65) Prior Publication Data

US 2013/0119107 A1 May 16, 2013

(30) Foreign Application Priority Data

Nov. 11, 2011 (CN) ..... 2011 2 0446573 U

(51) Int. Cl.
*B25C 5/16* (2006.01)
*B25C 1/00* (2006.01)
*B25C 1/18* (2006.01)

(52) U.S. Cl.
CPC . *B25C 1/008* (2013.01); *B25C 1/00* (2013.01); *B25C 1/188* (2013.01)

(58) Field of Classification Search
CPC ..... B25C 1/001; B25C 1/044; B25C 1/047; B25C 5/16; B27F 7/13; B27F 7/38
USPC ..... 227/8, 107, 110, 119, 139
See application file for complete search history.

(56) References Cited

U.S. PATENT DOCUMENTS

| | | | | | |
|---|---|---|---|---|---|
| 5,197,646 | A * | 3/1993 | Nikolich | 227/8 |
| 5,261,587 | A * | 11/1993 | Robinson | 227/8 |
| 5,368,213 | A * | 11/1994 | Massari, Jr. | 227/123 |
| 5,452,835 | A * | 9/1995 | Shkolnikov | 227/8 |
| 5,615,819 | A * | 4/1997 | Hou et al. | 227/109 |
| 5,632,431 | A * | 5/1997 | Lin | 227/109 |
| 5,649,660 | A * | 7/1997 | Akiba et al. | 227/8 |
| 6,138,887 | A * | 10/2000 | Nayrac et al. | 227/8 |
| 6,161,746 | A * | 12/2000 | Wey | 227/109 |
| 6,170,729 | B1 * | 1/2001 | Lin | 227/8 |
| 6,581,815 | B1 * | 6/2003 | Ho et al. | 227/142 |
| 6,641,021 | B2 * | 11/2003 | Jablonski | 227/120 |
| 6,739,490 | B1 * | 5/2004 | Shkolnikov et al. | 227/2 |
| 6,796,476 | B2 * | 9/2004 | Birk et al. | 227/2 |
| 6,851,595 | B1 * | 2/2005 | Lee | 227/142 |
| 6,915,937 | B2 * | 7/2005 | Lat et al. | 227/153 |
| 7,097,084 | B2 * | 8/2006 | Ho | 227/8 |
| 7,318,546 | B2 * | 1/2008 | Segura et al. | 227/142 |
| 7,431,187 | B2 * | 10/2008 | Tachihara et al. | 227/142 |
| 8,220,686 | B2 * | 7/2012 | Kestner et al. | 227/10 |
| 8,453,902 | B2 * | 6/2013 | Jang | 227/8 |
| 2002/0158103 | A1 * | 10/2002 | Driscoll et al. | 227/123 |
| 2008/0296341 | A1 * | 12/2008 | Francescon | 227/119 |

* cited by examiner

*Primary Examiner* — Gloria R Weeks

(57) ABSTRACT

A multifunctional nail gun includes a main body, a piston rod, a nail pipe sleeve, a guide rail and a nail feeder, wherein the rear end of the piston rod is positioned in the main body, while the front end extends into the nail pipe sleeve; the nail pipe sleeve is positioned at the front end of the main body; and the guide rail and the upper end of the nail feeder are fixed on the lower surface of the nail pipe sleeve. The multifunctional nail gun also includes a replaceable gun head, a nail pipe cap, an adjusting screw rod, and an adjusting knob.

12 Claims, 6 Drawing Sheets

MULTIFUNCTIONAL NAIL GUN

BACKGROUND OF THE PRESENT INVENTION

1. Technical Field

The present invention relates to a nail gun, in particular to a nail gun with the functions of precise hole finding, gun head replacement, etc.

2. Description of Related Art

Along with the continuous development and progress of the construction industry, the conventional nail gun has been more and more widely used in this field. A nail gun comprises a main body and a nail shooting device. The shooting device mainly pushes a piston rod forward by the thrust generated by the explosion of gunpowder or compressed air, so the piston rod pushes and shoots a nail fed by a nail feeder to a predetermined position along a nail pipe. To prevent deviation, hole finding is usually required. U.S. Pat. Nos. 5,452,835 and 7,628,304 respectively disclose a locating device for a nail gun, wherein the hole finding function is realized but the structure only has a single function.

BRIEF SUMMARY OF THE PRESENT INVENTION

For the above mentioned reasons, an objective of the present invention is to provide a multifunctional nail gun with a gun head replacement structure capable of realizing functions of hole finding, limiting, nailing depth adjustment, nailing force adjustment, rapid nail jamming removal, and nail-less locking.

To realize the mentioned objective, the present invention adopts following technical scheme. A multifunctional nail gun comprises a main body, a piston rod, a nail pipe sleeve, a guide rail and a nail feeder, wherein the rear end of the piston rod is positioned in the main body, while the front end of the piston rod extends into the nail pipe sleeve; the nail pipe sleeve is positioned on the front end of the main body; the guide rail and the upper end of the nail feeder are fixed on the lower surface of the nail pipe sleeve. The multifunctional gun also comprises a gun head, a nail pipe cap, an adjusting screw rod and an adjusting knob, wherein the gun head is provided with a first connection portion for receiving the front end of the adjusting screw rod; the first connection portion is positioned in a receiving cavity of the nail pipe cap; the front end face of the nail pipe cap is provided with a nozzle; the upper surface of the nail pipe cap is provided with a second connection portion and a third connection portion which are connected with the rear end of the adjusting screw rod; the adjusting knob is sleeved on the adjusting screw rod and positioned between the second and third connection portions; the nail pipe cap is movably positioned in the nail pipe sleeve; the rear end face of the nail pipe cap is pressed against the main body; both the nail feeder and the guide rail are positioned below the nail pipe cap; the inner walls on both sides of the nail pipe cap are respectively provided with a chute whose width is greater than the thickness of the rear end of the nail end cap; and the rear end of the nail pipe cap is moveably positioned in the chute.

Furthermore, the nail head is integrally molded by the first connection portion and the limiting portion. When the gun is used to process a work piece with holes, such as a metal connector for fixing wood frame, the nozzle of the nail pipe cap extends in front of the front end face of the limiting portion to be matched with the hole; and when the gun conducts hole finding or other functions, the front end face of the limiting portion extends in the front of the nozzle of the nail pipe cap.

Furthermore, the rear end of the adjusting screw rod is respectively bonded with holes formed in the second and third connection portions and the adjusting knob positioned in the second and third connection portions.

Furthermore, the lateral side of the nail pipe cap is provided with a notch, and when the gun conducts of the function of nail-less locking, the upper end of the nail feeder is bonded with this notch.

Furthermore, when the gun is used for hole finding and shooting, the third connection portion positioned in the rear of the adjusting knob is pressed against the step face of the nail pipe sleeve.

Furthermore, the gun head is integrally molded by the first connection and the limiting portion. When the gun is used to adjust the nailing depth and nailing force, the adjusting knob is rotated to move the whole gun head forward, and at this moment, the front end face of the limiting portion is positioned in the front of the nozzle of the nail pipe cap.

Furthermore, the lower end of the limiting portion is open.

Furthermore, the lower end of the limiting portion is provided with a fixed trajectory device.

The present invention has following advantages: when the gun conducts the hole finding function, which means the gun is used to process a work piece with holes, before shooting, the nozzle on the front end face of the nail pipe cap is jacked into the hole on the shooting surface of the work piece, during shooting the nail and the piston rod work together to open the nail pipe cap, the rear end of the nail pipe cap can swing into the chute of the nail pipe sleeve to shoot the nail into the hole; when the gun is used to adjust the nailing depth, the adjusting knob is rotated to move the gun head which is connected with the adjusting knob via the screw rod out of the front end face of the nozzle of the nail pipe cap, at this moment, this structure has no hole finding function, but can adjust the nailing depth and the nailing force to avoid damage to the work piece; if the adjusting knob is continuously rotated until the adjusting screw rod is separated from the second and third connection portions, at this moment the adjusting screw rod, gun head, nail pipe cap, and adjusting knob can be taken down to remove the fault like nail jamming; and the gun head is replaceable, so other functions can be realized just by replacing the gun head with the corresponding function.

DETAILED DESCRIPTION OF THE INVENTION

To enable those skilled in this technical field to better understand the scheme, the present invention is further described in details by means of the attached drawings and the embodiments.

Figure 1:
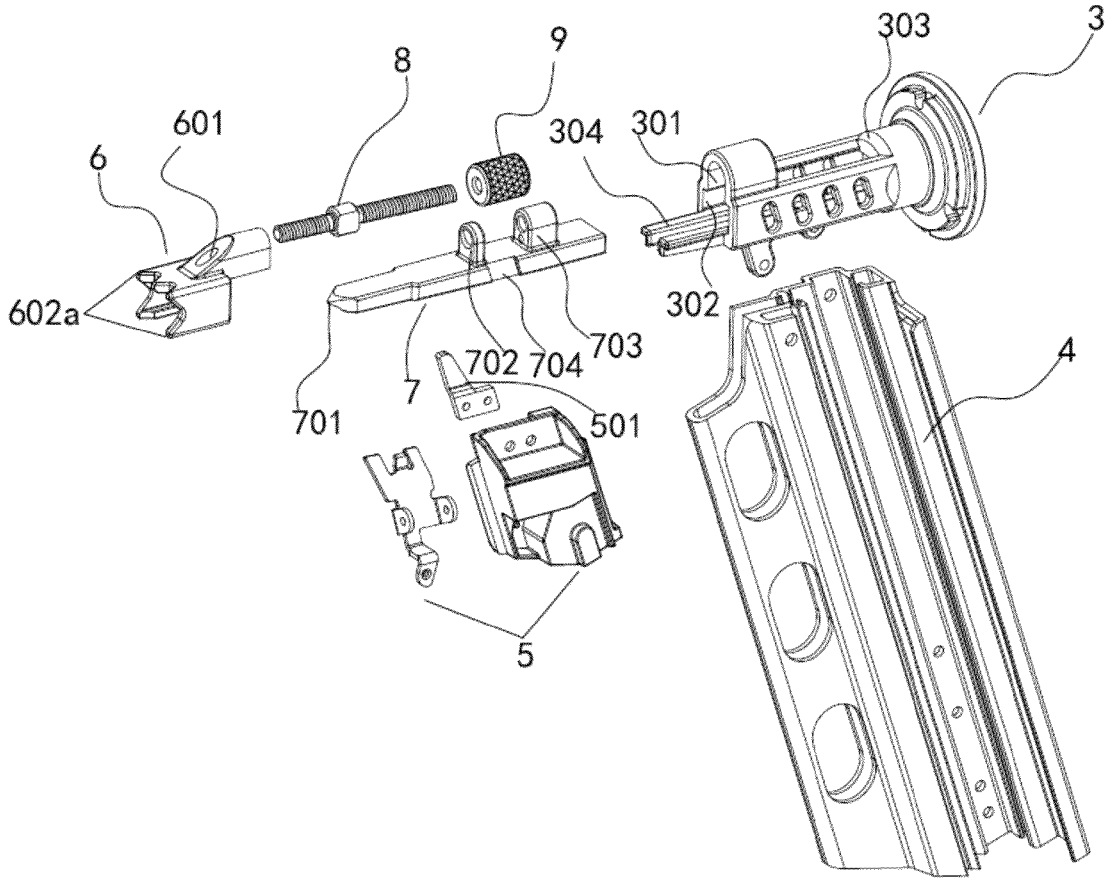
FIG. 1 is an exploded view of a nail pipe component, a nail pipe sleeve, a guide rail and a nail feeder of the present invention.
Figure 2:
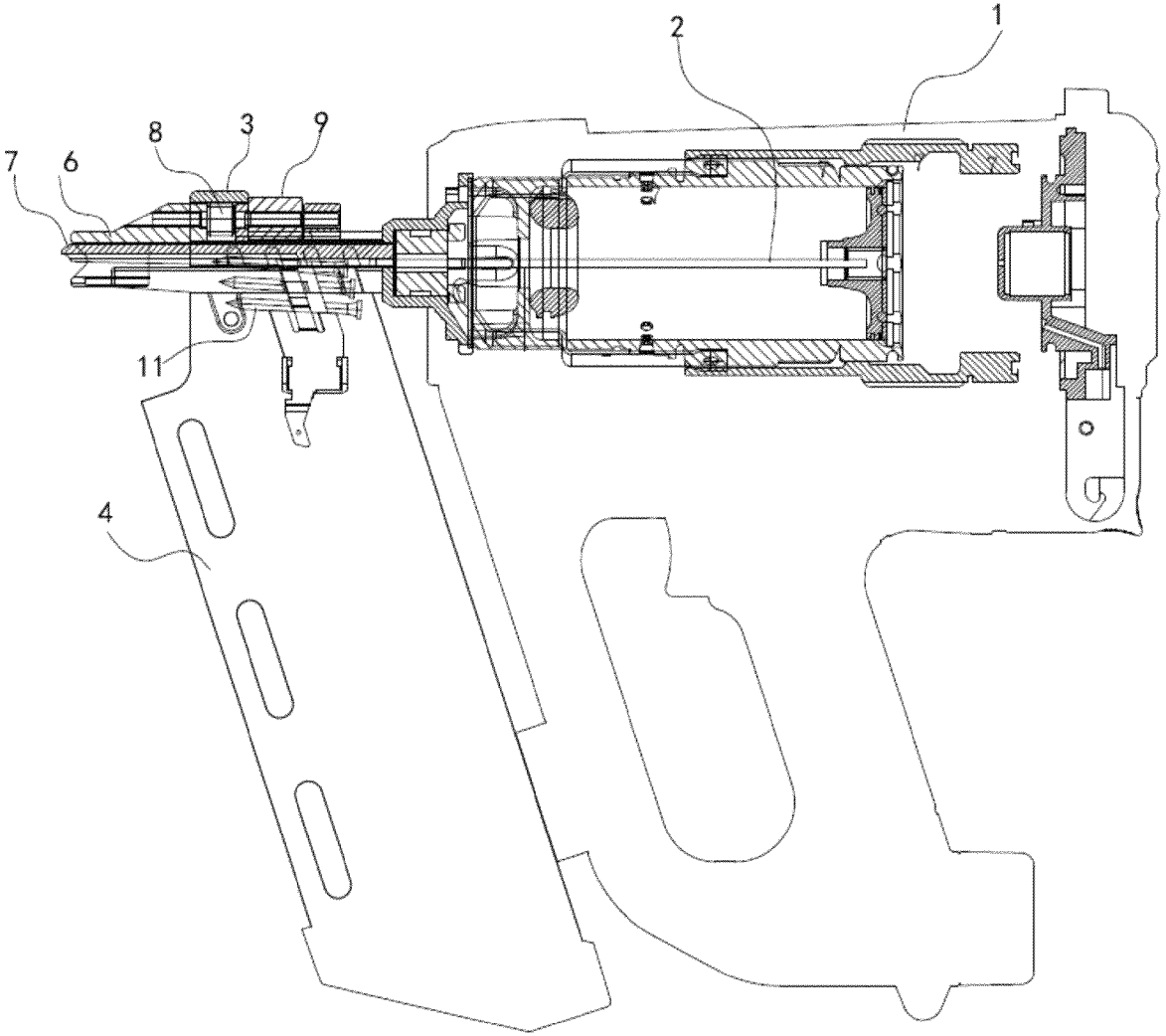
FIG. 2 is a sectional view of the present invention.

As shown in FIGS. 1-2, a multifunctional nail gun comprises a main body 1, a piston rod 2, a nail pipe sleeve 3, a guide rail 4 and a nail feeder 5, wherein the rear end of the piston rod 2 is positioned in the main body 1 and the front end of the piston rod 2 extends into the nail pipe sleeve 3; the nail pipe sleeve 3 is positioned at the front end of the main body, and the guide rail 4 and the upper end of the nail feeder 5 are fixed on the lower surface of the nail pipe sleeve 3.

The multifunctional nail gun also comprises a gun head 6, a nail pipe cap 7, an adjusting screw rod 8 and an adjusting knob 9, wherein the gun head 6 is provided with a first connection portion 601 receiving the front end of the adjusting screw rod, the first connection portion 601 is moveably positioned in a receiving cavity 301 of the nail pipe sleeve; the front end face of the nail pipe cap 7 is provided with a nozzle 701, the upper surface of the nail pipe cap 7 is provided with a second connection portion 702 and a third connection portion 703 which are connected with the rear end of the adjusting screw rod, and the adjusting knob 9 is sleeved on the adjusting screw rod 8 and positioned between the second connection portion 702 and the third connection portion 703; the nail pipe cap 7 is moveably positioned in the nail pipe sleeve, the rear end face of the nail pipe cap 7 is pressed against the main body, the nail feeder 5 and the guide rail 4 are both positioned below the nail pipe cap 7; and the inner walls on both sides of the nail pipe sleeve 3 are respectively provided with a chute 302 of which the width is greater than the thickness of the rear end of the nail pipe cap, and the rear end of the nail pipe cap 7 is moveably positioned in the chute 302, which means that the rear end of the nail pipe cap 7 can swing into the nail pipe sleeve 3. The gun head 6, nail pipe cap 7, adjusting screw rod 8 and adjusting knob 9 can be bonded together to form a movable component which is called as nail pipe cap component for short.

Figure 4:
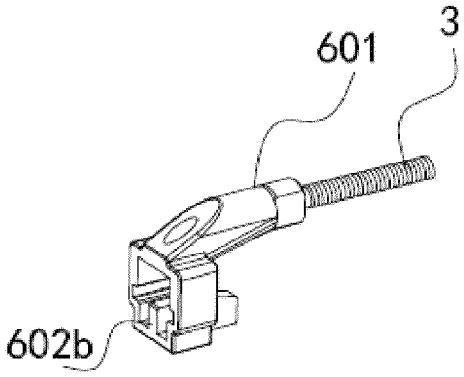
FIG. 4 is a three-dimensional view of a gun head of the present invention for shooting shorter nails.

The gun head of the present invention is a device capable of adjusting limit and nailing force. The gun head 6 is integrally molded by a first connection portion 601 and a limiting portion 602; the shape of the limiting portion 602 varies with the length of the nail to be shot; to shoot longer nails, the front end face of the limiting portion 602 is provided with plural nozzles 602*a*, and the lower end of the limiting portion 602 is open, as shown in FIG. 1; to shoot shorter nails, the lower end of the limiting portion 602 is provided with a fixed trajectory device 602*b* to help the piston rod shoot the shorter nails to the predetermined position, as shown in FIG. 4; compared with the prior art, the gun head 6 is integrally molded, and can be tuned in use, which means that the gun head 6 can be tuned forward or backward to fit the nails in different dimensions.

The lateral side of the nail pipe cap 7 is provided with a notch 704.

As shown in FIG. 1, the upper end of the nail feeder 5 is provided with a pinch plate 501.

Figure 3A:
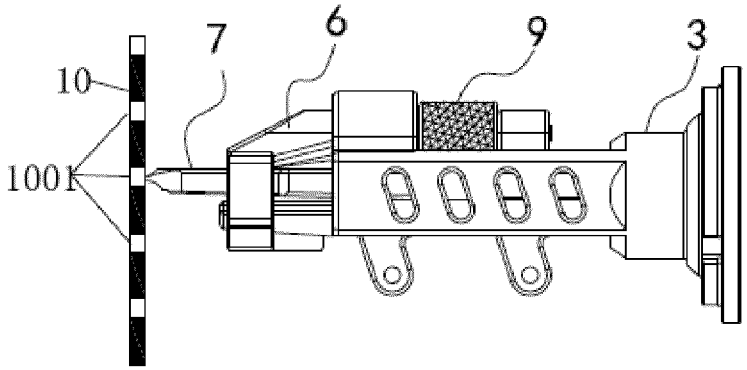
FIG. 3*a* is a schematic view of the initial state of the present invention used to process a work piece with holes.
Figure 3B:
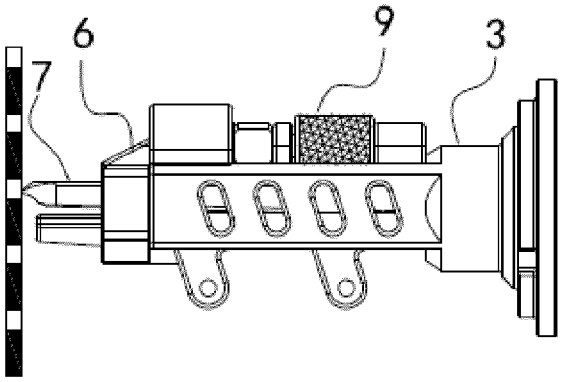
FIG. 3*b* is a hole finding schematic view of the present invention used to process a work piece with holes.
Figure 3C:
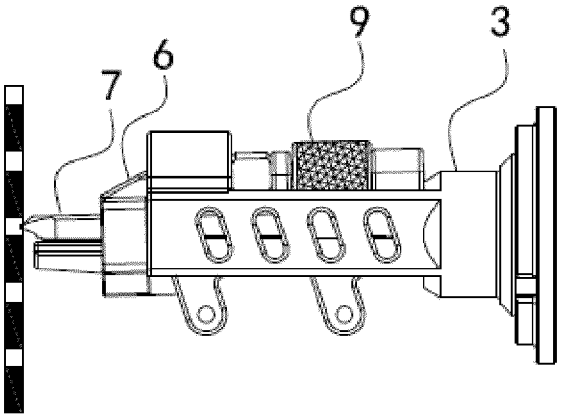
FIG. 3*c* is a shooting schematic view of the present invention used to process a work piece with holes.

As shown in FIGS. 3*a*-3*c*, the example that the utility model nails a steel plate 10 with a hole 1001 is used to describe the hole finding of the nozzle 701 at the front end of the nail pipe cap: the adjusting knob 9 is rotated to drive the gun head 6 move backward until the nozzle 701 is moved to in the front of the gun head 6, when the nail gun is pressed on the steel plate 10 to be fixed, the nozzle 701 of the nail pipe cap is inserted into the hole 1001, and at this moment, the third connection portion 703 in the rear of the adjusting knob 9 is pressed against the step face 303 of the nail pipe sleeve 3. The nail gun is triggered, when the nail 11 is jacked to a certain position by the piston rod 2, the nail 11 and the piston rod 2 together move upward to open the nail pipe cap component, the lower surface 304 of the nail pipe sleeve 3 provides support to make the nozzle 701 of the nail pipe cap (and the nail gun) to jump and leave the steel hole 1001, at this moment the motion route of the nail is almost aligned with the steel hole 1001, additionally, the steel hole 1001 can be matched with the nail tip to conduct guidance, the nail 11 can be precisely shot into the hole 1001.

Figure 5:
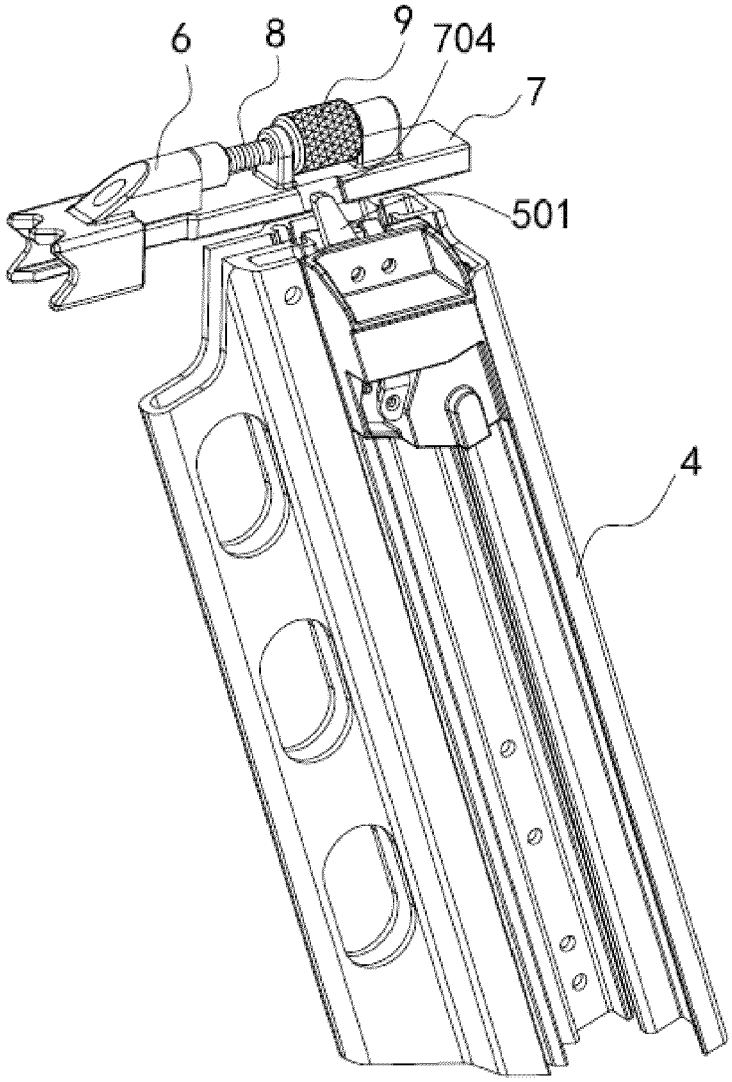
FIG. 5 is a schematic view of the present invention realizing the nail-less locking function.

As shown in FIG. 5, the present invention conducts nailless locking function: when there are a few nails left in the nail gun, the pinch plate 501 on the upper end of the nail feeder 5 is moved to the position to insert into the notch 704 of the nail pipe cap, at this moment the sliding route of the nail pipe cap component is blocked, so the nail gun cannot work and hints the step of supplementing the nails.

Figure 6A:
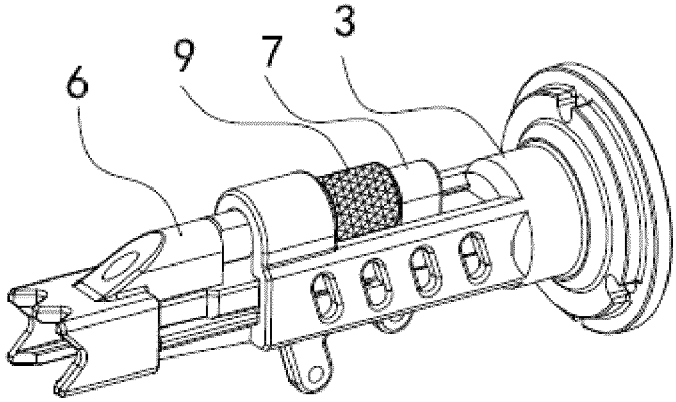
FIG. 6*a* is a schematic view of the present invention with a small nailing depth and a small nailing force.
Figure 6B:
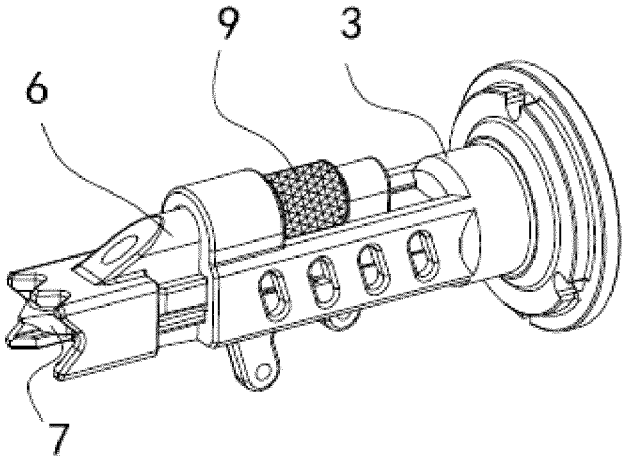
FIG. 6*b* is a schematic view of the present invention with a large nailing depth and a large nailing force.

As shown in FIGS. 6*a*-6*b*, the present invention conducts the function of adjusting the nailing depth and nailing force: the adjusting knob 9 is rotated to move the gun head 6 forward until the limiting portion 602 of the gun head 6 is positioned in the front of the nozzle 701 of the nail pipe cap 7, generally speaking, the farther the front end of the limiting portion 602 is away from the nozzle 701, the shallower the shot nail is, and the smaller the nailing force is, vice versa. It should be noted that when the nail gun adjusts the nailing depth, it loses the function of hole finding because the gun head 6 covers up the nozzle 701 of the nail pipe cap.

Figure 7A:
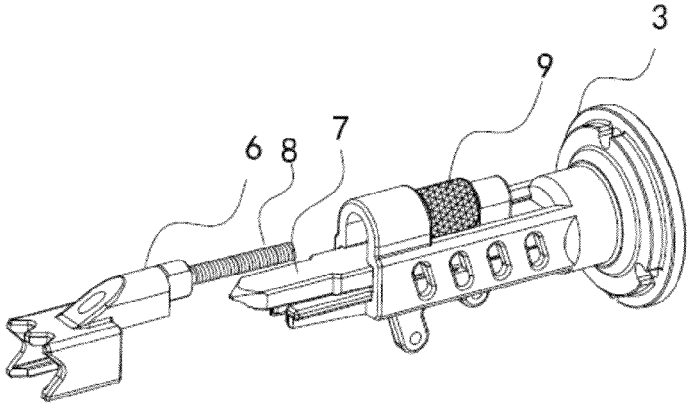
FIG. 7*a* is a schematic view of the first step of rapid fault removal of the present invention.
Figure 7B:
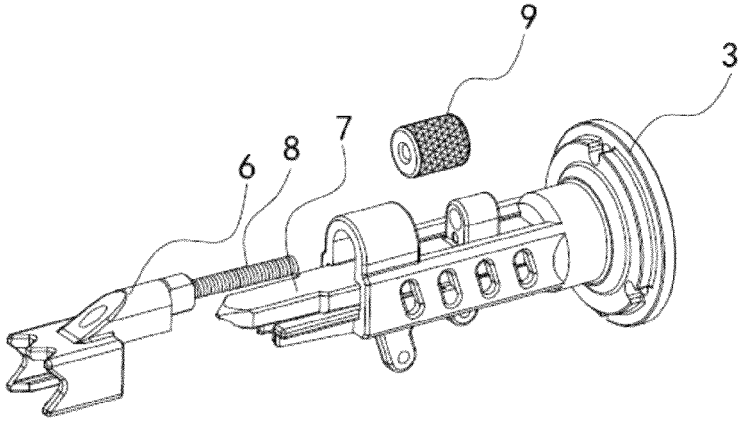
FIG. 7*b* is a schematic view of the second step of rapid fault removal of the present invention.
Figure 7C:
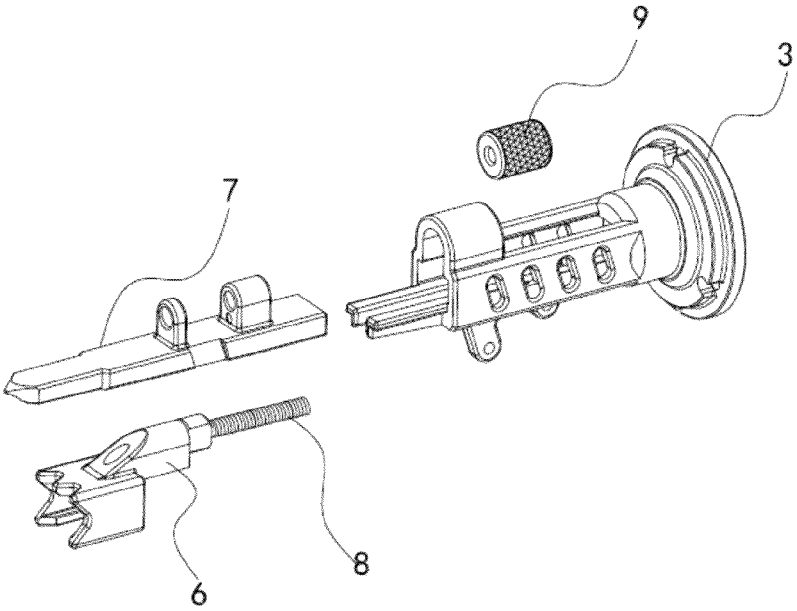
FIG. 7*c* is a schematic view of the third step of rapid fault removal of the present invention.

FIGS. 7*a*-7*c* illustrate the nail pipe cap component which describes the fault removal function and other functions of the present invention: the adjusting knob 9 is continuously rotated to separate from the adjusting screw rod 8, the adjusting knob 9 is picked up from the upside, then the nail pipe cap 7 and the gun head 6 can slide forward, and the cavity 301 of the nail pipe cap is wholly hollow, which is convenient for removing faults like nail jamming. Other functions can be realized by assembling the elements in the reverse sequence or replacing the gun head component with other functions.

The mentioned embodiment is just a preferable embodiment of the present invention. Those skilled in this field shall know that any variation, modification or substitution in the technical concept of the present invention shall be within the protection scope of the present invention. Therefore, the protection scope of the present invention is subject to the claims.

What is claimed is:

1. A multifunctional nail gun, comprising a main body, a piston rod, a nail pipe sleeve, a guide rail, and a nail feeder, wherein the rear end of the piston rod is positioned in the main body, while the front end of the piston rod extends into the nail pipe sleeve; the nail pipe sleeve is positioned on the front end of the main body; the guide rail and the upper end of the nail feeder are fixed on the lower surface of the nail pipe sleeve; also comprising a gun head, a nail pipe cap, an adjusting screw rod and an adjusting knob, wherein the gun head is provided with a first connection portion for receiving the front end of the adjusting screw rod; the first connection portion is positioned in a receiving cavity of the nail pipe cap; the front end face of the nail pipe cap is provided with a nozzle; the upper surface of the nail pipe cap is provided with a second connection portion and a third connection portion which are connected with the rear end of the adjusting screw rod; the adjusting knob is sleeved on the adjusting screw rod and positioned between the second and third connection portions; the nail pipe cap is movably positioned in the nail pipe sleeve; the rear end face of the nail pipe cap is pressed against the main body; both the nail feeder and the guide rail are positioned below the nail pipe cap; the inner walls on both sides of the nail pipe cap are respectively provided with a chute whose width is greater than the thickness of the rear end of the nail end cap; and the rear end of the nail pipe cap is moveably positioned in the chute.

2. The multifunctional nail gun according to claim 1, wherein the gun head is integrally molded by the first connection portion and a limiting portion; and when the gun is used to process a work piece with holes, the nozzle of the nail pipe cap extends in front of the front end face of the limiting portion to be matched with the hole.

3. The multifunctional nail gun according to claim 1, wherein the rear end of the adjusting screw rod is respectively bonded with holes formed in the second and third connection portions and the adjusting knob positioned in the second and third connection portions.

4. The multifunctional nail gun according to the claim 2, wherein the lower end of the limiting portion is open.

5. The multifunctional nail gun according to the claim 2, wherein the lower end of the limiting portion is provided with a fixed trajectory.

6. The multifunctional nail gun according to the claim 3, wherein the lateral side of the nail pipe cap is provided with a notch; and when the gun conducts the function of locking without a nail, the upper end of the nail feeder is bonded with this notch.

7. The multifunctional nail gun according to the claim 3, wherein when the gun is used for hole finding or shooting, the third connection portion on the rear side of the adjusting knob is pressed against the step face of the nail pipe cap.

8. The multifunctional nail gun according to the claim 1, wherein the lateral side of the nail pipe cap is provided with a notch; and when the gun conducts the function of locking without a nail, the upper end of the nail feeder is bonded with this notch.

9. The multifunctional nail gun according to the claim 1, wherein when the gun is used for hole finding or shooting, the third connection portion on the rear side of the adjusting knob is pressed against the step face of the nail pipe cap.

10. The multifunctional nail gun according to claim 1, wherein the gun head is integrally molded by the first connection portion and the limiting portion; when the gun conducts the function of adjusting the nailing depth, the adjusting knob is rotated to move the whole gun head forward or backward, and at this moment, the front end face of the limiting portion is positioned in the front of the nozzle of the nail pipe cap.

11. The multifunctional nail gun according to the claim 10, wherein the lower end of the limiting portion is open.

12. The multifunctional nail gun according to the claim 10, wherein the lower end of the limiting portion is provided with a fixed trajectory.

* * * * *